United States Patent [19]

Ovshinsky et al.

[11] Patent Number: 4,723,994

[45] Date of Patent: Feb. 9, 1988

[54] METHOD OF PREPARING A MAGNETIC MATERIAL

[75] Inventors: Stanford R. Ovshinsky, Bloomfield Hills, Mich.; Hellmut Fritzsche, Chicago, Ill.; Julius J. Harwood, West Bloomfield, Mich.; Alan M. Kadin, Troy, Mich.; John E. Keem, Bloomfield Hills, Mich.

[73] Assignee: Ovonic Synthetic Materials Company, Inc., Troy, Mich.

[21] Appl. No.: 919,931

[22] Filed: Oct. 17, 1986

[51] Int. Cl.[4] ..... H01F 1/02

[52] U.S. Cl. ..... 75/0.5 C; 148/103; 148/105

[58] Field of Search ..... 75/0.5 C; 148/103, 105

[56] References Cited

U.S. PATENT DOCUMENTS

| | | | |
|---|---|---|---|
| 3,764,295 | 10/1973 | Lindskog | 75/0.5 C |
| 4,347,201 | 8/1982 | Sagawa | 148/103 |
| 4,369,075 | 1/1983 | Nobuo | 148/103 |
| 4,604,147 | 8/1986 | Brandis | 148/103 |

*Primary Examiner*—Peter D. Rosenberg

*Attorney, Agent, or Firm*—Richard M. Goldman; Marvin S. Siskind

[57] ABSTRACT

A method of forming a magnetic material. The magnetic material is a solid mass of grains, and has magnetic parameters characterized by: (1) a maximum magnetic energy product, $(BH)_{max}$, greater than 15 megagaussoersteds; and (2) a remanence greater than 9 kilogauss. The magnetic material is prepared by a two step solidification, heat treatment process. The solidification process is carried out by: (a) providing a molten precursor alloy; (b) atomizing the molten alloy through nozzle means to form individual droplets of the molten alloy; and (c) quenching the droplets of the molten alloy to form solid particles of the alloy. The solid particles have a morphology characterized as being one or more of (i) amorphous; (ii) microcrystalline; or (iii) polycrystalline. The grains within the solid have, at this stage of the process, an average grain characteristic dimension less than that of the heat treated magnetic material. In the second, or heat treating, stage of the process, the atomized solid particles are heat treated to form a solid material comprised or grains meeting at grain boundaries. The grains and grain boundaries have the morphology of the magnetic material.

11 Claims, 2 Drawing Figures

METHOD OF PREPARING A MAGNETIC MATERIAL

FIELD OF THE INVENTION

The invention relates to permanent magnetic alloy materials and methods of preparing them.

BACKGROUND OF THE INVENTION

There has long been a need for a relatively inexpensive, strong, high performance, permanent magnet. Such high performance permanent magnets would be characterized by relatively high magnetic parameters, e.g. coercive force ($H_c$) or coercivity, remanent magnetization or remanence, and maximum energy product.

Moreover, an ideal high-performance permanent magnet should exhibit a square magnetic hysteresis loop. That is, upon application of an applied magnetic field H greater than the coercive force Hc, all of the microscopic magnetic moments should align parallel to the direction of the applied force to achieve the saturation magnetization Ms. Moreover, this alignment must be retained not only for H=0 (the remanent magnetization Mr), but also for a reverse applied magnetic force of magnitude less than Hc. This would correspond to a maximum magnetic energy product (the maximum negative value of BH) of $$(Mr^2/4)=(Ms^2/4)$$

Unfortunately, this ideal situation is at best metastable with respect to the formation of magnetic domains in other directions, which act to reduce Mr and $BH_{max}$.

Conventional high-performance permanent magnets that approach square-loop behavior have four general requirements:

1. The material must be composed primarily of a ferromagnetic element or compound with a Curie temperature Tc that significantly exceeds the application temperature Ta, and with Ms at Ta large. Practically speaking, this requires either Fe or Co as the major constituent.

2. In order to obtain a high coercive force, the material must consist of an assembly of small particles or crystallites.

3. These particles or crystallites must exhibit microscopic magnetic anisotropy, i.e. they must have a preferred "easy axis" of magnetization. This can follow either from shape anisotropy or magneto-crystalline interaction.

4. These microscopically anisotropic particles must be aligned substantially in parallel within the macroscopic assembly, in order to achieve values of Mr that approach Ms, i.e. square-loop behavior.

The prior art teaches that good permanent magnetic materials, e.g., having maximum magnetic energy products of about 15 megagaussoersteds, consist of a conglomeration of non-interacting substantially crystallographically oriented uniaxial particles. When a sufficiently large magnetic field is applied in a given direction, the individual vector magnetizations of each of these particles point along the applied field, corresponding to the maximum or saturation value of the net magnetization, $M_s$. As the applied magnetic field is reduced to zero, the vector magnetization of each particle relaxes back to the easy magnetic axis of the particle, so that the net resultant remanent magnetization, $M_r$, may be less than $M_s$.

This is more fully elucidated by the following geometrical model, in which the "easy axis" of magnetization lies along a preferred axis, c. For an isolated uniformly magnetized particle, the magnetization vector, M, lies along the c axis for a zero applied field. If a field is applied in an arbitrary direction z, the magnetization is rotated away from the c axis until, at sufficiently large fields, M is parallel to z and $M_z$ is equal to $M_s$. When the field is removed, the magnetization relaxes back parallel to the c axis, subject to the condition that the projection of magnetization along the c axis is positive.

E. C. Stoner and E. V. Wohlfarth, Phil. Trans. Royal Soc. (London), A. 240, 599 (1948) have calculated the hysteresis loop for such a particle for different orientations of the c axis with respect to z. For the case of a sample comprising a large number of such non-interacting particles oriented along some direction, the magnetic properties for the material or sample are the sum or average of the properties of the individual particles. Such a sample or material is hereinafter referred to as an anisotropic material. Anisotropic materials have at least one magnetic property which is a strong function of the direction of measurement. Such materials are characterized by a single "easy direction" of magnetization, where the value of the property greatly exceeds the value in other directions of magnetization. If the particles are non-interacting, the maximum energy product varies from a maximum value of 0.25 $(M_s)^2$, when z is parallel to the c axis, to 0 when z is perpendicular to the c axis. For a theoretical anisotropic material with $M_s$ equal to 16 and $H_c$ chosen to be greater than $M_s$, the maximum theoretical value of the energy product of the hysteresis loop is 64 megagaussoersteds.

Stoner and Wohlfarth have carried out the same method of analysis for an ideal array of randomly oriented non-interacting uniformly magnetized particles. Since the array is isotropic there is no dependence of the hysteresis loop on the direction of the applied field. The maximum theoretical value of the energy product of such a loop is dependent on $M_s$ and $H_c$. If $M_s$ is chosen to equal 16 kilogauss and $H_c$ is chosen to be much greater than $M_s$, then the maximum energy product is 16 megagaussoersteds.

Hence, the teaching of the prior art for a perfectly oriented non-interacting material (anisotropic) is that the maximum energy product is at least four (4) times that of the same material when randomly oriented (isotropic).

For a general distribution of orientations of non-interacting particles, as a consequence of simple vector geometry, $$(M_r/M_s)=[\cos(theta)],$$

where theta is the angle between the applied field and the easy axis of a given particle, and the result, indicated by double brackets, represents the size weighted average over all of the particles. As is well understood in the art, $M_r/M_s=1$ along the direction of orientation of a perfectly oriented, non-interacting, permanent magnet sample (anisotropic), and $M_r/M_s=0.5$ in all directions for a completely unoriented, non-interacting sample (isotropic). See, e.g., R. A. McCurrie, "Determination of the Easy Axis Alignment in Uniaxial Permanent Magnets for Remanence Measurements", J. Appl. Phys., Vol. 52, (No. 12), pages 7344–7346 (December 1981). Observations in the literature are consistent with this prediction. See, e.g., J. F. Herbst and J. C. Tracy, "On Estimating Remanent Magnetization from X-Ray Pole Figure Date", J. Appl. Phys., Vol. 50 (No. 6), pp. 4283–4284 (June 1979).

A figure of merit, which applicants refer to as the magnetic retention parameter, is $$Q=Sum_{x,y,z}(M_r/M_s)^2,$$

where $M_s$ and $M_r$ are measured with the applied magnetic field along three orthogonal directions. Theoretically, for magnetic materials of the prior art, Q approaches 1 for perfectly oriented, non-interacting, particles or crystallites (anisotropic) and 0.75 for completely unoriented, non-interacting, crystallites (isotropic). The behavior for reported values of permanent magnetic materials of the prior art tend to produce values of Q which are substantially below the theoretical values. See, e.g., McCurrie; Herbst and Tracy; and Stoner and Wohlfarth; above.

Prior art systems which are non-interacting and conform to the assumptions of and models in Stoner and Wohlfarth are described in the Background sections of commonly assigned copending U.S. application Ser. No. 816,778, filed Jan. 10, 1986, of R. Bergeron, R. McCallum, K. Canavan, and J. Keem for *Enhanced Remanence Premanent Magnetic Alloy Bodies and Methods of Preparing Same*, and U.S. application Ser. No. 893,516, filed Aug. 5, 1986 of R. Bergeron, R. McCallum, K. Canavan, J. Keem, A. Kadin, and G. Clemente, for *Enhanced Remanence Permanent Magnetic Alloy and Bodies Thereof*. The prior art materials described and discussed in the Background sections of our earlier applications do not exhibit any deviations from the assumptions and models of Stoner and Wohlfarth.

Deviations from $(Mr/Ms)=[\mathrm{Cos}(theta)]$corresponding to larger values of Mr might be expected to occur if the particles were permitted to interact with one another. Suggestions of this sort have appeared in the magnetic recording literature, where the proposed interaction was due to long range magnetic dipole fields. See, for example, H. N. Bertram and A. K. Bhatia, *The Effect of Interaction on the Saturation Remanence of Particulate Assemblies*, IEEE Trans. on Magnetics, MAG-9, pp 127–133 (1983), and R. F. Soohoo, *Influence of Particle Interaction on Coercivity and Squareness of Thin Film Recording Media*, J. Appl. Phys., Vol 52(3), pp 2459–2461 (1981). However, this assumption of interactions has been questioned. See, for example, P. M. Davis, *Effects of Interaction Fields on the Hysteretic Properties of Assemblies of Randomly Oriented Magnetic or Electric Moments*, J. Appl. Phys., Vol 51 (2), pp 594–600 (1980).

Suggestions of short range interactions based on exchange have also been made with respect to amorphous iron-rare earth alloys at cryogenic temperatures by E. Callen, Y. L. Liu, and J. R. Cullen, *Initial Magnetization, Remanence, and Coercivity of the Random Anisotropy Amorphous Ferromagnet* Phys. Rev. B, Vol. 16, pp 263–270 (1977).

The literature does not contain any verified indications of enhanced values of Mr relative to those predicted by Stoner and Wohlfarth, above, in isotropic permanent magnetic materials.

However, contrary to the limited but negative teachings of the prior art interaction between crystallites has been used to achieve enhanced magnetic properties in bulk solid materials. Magnetic materials which utilize interaction are described in commonly assigned copending U.S. application Ser. No. 816,778, filed Jan. 10, 1986, of R. Bergeron, R. McCallum, K. Canavan, and J. Keem for *Enhanced Remanence Premanent Magnetic Alloy Bodies and Methods of Preparing Same*, and U.S. application Ser. No. 893,516, filed Aug. 5, 1986 of R. Bergeron, R. McCallum, K. Canavan, J. Keem, A. Kadin, and G. Clemente, for *Enhanced Remanence Permanent Magnetic Alloy and Bodies Thereof*, both of which are incorporated herein by reference.

Described therein is a class of permanent magnetic alloys which exhibit superior magnetic properties as measured in all spatial directions, that is, isotropically. The magnetic parameters are of a magnitude which the prior art teaches to be only attainable in one spatial direction, that is, anisotropically, and to be only attainable with aligned materials.

The magnetic materials described in the incorporated patent applications have a ratio of net remanent magnetization ($M_r$) to net saturation magnetization ($M_s$), exceeding 0.5 and approaching 1.0, in all directions, without any significant preferred crystallite orientation. This is a clear violation of the consequences of the Stoner and Wohlfarth's model and the assumptions of the prior art that the grains must be microscopically anisotropic grains that are aligned substantially in parallel within the macroscopic body in order to achieve values of Mr approaching Ms, i.e., square hysteresis loop behavior.

These permanent magnetic materials have magnetic retention parameters, Q, as described above, greater than 1. The theoretical limit of the magnetic retention parameter, Q, for the herein contemplated materials is believed to approach 3, rather than the theoretical values of 1.0 and 0.75 respectively, for aligned (anisotropic) and unaligned (isotropic), non-interacting materials of the prior art.

Ribbon samples of the as quenched materials described above, without further processing, exhibit enhanced magnetic parameters, i.e., remanent magnetization, $M_r$, greater than 9 kilogauss, coercive force, $H_c$, greater than 8 kilooersteds, and preferably greater than 11 kilooersteds, and maximum energy product (BH)max greater than 15 megagaussoersteds with similar values measured in all directions, i.e., in the plane of the ribbon and perpendicular to the plane of the ribbon. In the latter case the value was obtained after a standard correction (a geometric demagnetization factor as described, for example, in R. M. Bozorth, *Ferromagnetism*, D. VanNostrand Co., New York, (1951), at pages 845–847) for the shape anisotropy of the ribbon.

The saturation magnetization $M_s$ of the ribbon, i.e., the magnetization in the limit for large applied fields, e.g., an applied magnetic field above about 50 kilogauss, is 15 to 16 kilogauss, also in all directions. In order to directly measure saturation magnetization, $M_s$, the applied field should be at least three times the coercive force, $H_c$. Alternatively, the value of $M_s$ can be estimated based on the values thereof for compositionally similar materials. The values correspond to a value of $M_r/M_s$ greater than 0.6, and a magnetic retention parameter, Q, greater than 1, in contradistinction to the clear teachings of the prior art for a macroscopically isotropic, non-interacting material.

Typical magnetic parameters for the magnetic alloys described in the above incorporated patent application are as shown in Table I of U.S. application Ser. No. 893,516, filed Aug. 5, 1986, Table V of U.S. patent application Ser. No. 816,778. (An $M_s$ of 16 kilogauss was used.)

As can be seen from Table I of U.S. application Ser. No. 893,516, the samples of the materials described therein exhibit superior relevant magnetic parameters throughout the volume of the bulk solid, evidencing interaction between grains. The properties are especially superior when compared with the properties of the isotropic materials of the prior art listed in Table III of U.S. application Ser. No. 816,778. When compared with the anisotropic prior art materials listed in Table IV of U.S. application Ser. No. 816,778, the samples of the inventions described in the aforementioned U.S. patent application Ser. Nos. 816,778 and 893,516 (filed Aug. 5, 1986) exhibit comparable but isotropic magnetic properties, and were prepared without the costly, complicated alignment steps necessary in the prior art.

The magnetic alloy materials of U.S. application Ser. Nos. 816,778 and 893,516 have been prepared by the melt spinning process, and more particularly by the free jet casting process.

In the free jet casting process a jet of molten metal is expelled under a head of inert gas from a crucible onto a rapidly rotating chill wheel. This jet of molten metal forms a puddle of molten metal on a rapidly rotating chill wheel. The top of the puddle appears to stand stationary beneath the orifice of the crucible, while the bottom of the puddle appears to be continuously drawn away from the crucible orifice. We have observed an instability associated with the interaction between the chill wheel and the puddle. This instability is associated with a high degree of variance of magnetic properties of the cast products and a concommitant low yield of enhanced remanence magnetic alloy material.

SUMMARY OF THE INVENTION

These instabilities of the free jet casting process and the associated low yields of enhanced remanence magnetic material are obviated by the method of this invention.

The magnetic material is prepared by a two step solidification, heat treatment process. The solidification process yields a very low coercivity material, characterized as being one or more of amorphous, microcrystalline, or polycrystalline. The grains within the solid have, at this stage of the process, an average grain characteristic dimension less than that of the heat treated magnetic material, and too small to provide a practical coercivity.

The solidification process is carried out by: (a). providing a molten precursor alloy; (b). atomizing the molten alloy through orifice means to form individual droplets of the molten alloy; and (c). quenching the droplets of the molten alloy to form solid particles of the alloy.

In the second, or heat treating, stage of the process, the atomized solid particles are heat treated to form a solid material having a morphology that provides a practical coercivity and the above described enhancement of remanence. The heat treated solid is comprised of grains meeting at grain boundaries. The grains and grain boundaries have the morphology of the enhanced remanence magnetic material.

THE FIGURES

The invention may be understood by reference to the following figures.

DETAILED DESCRIPTION OF THE INVENTION

Figure 2:
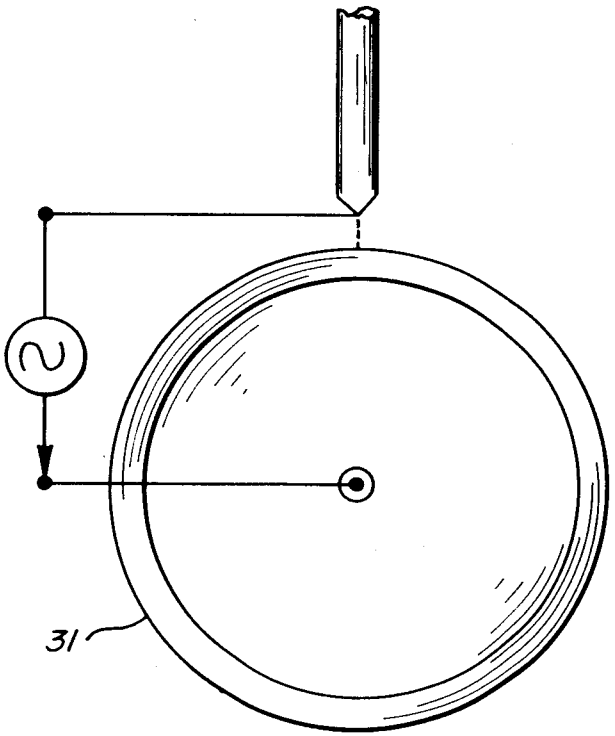
FIG. 2 show apparatus for the formation of molten metal droplets by the use of an electrostatic field.

According to the invention there is provided a method of forming a class of magnetic alloy materials having superior magnetic properties. These magnetic alloy materials are high remanence materials that do not obey the Stoner and Wohlfarth assumptions of non-interacting particles. To the contrary, the enhanced magnetic properties give clear evidence of interaction across grain boundaries of the individual grains or crystallites.

The alloys prepared by the method herein are substantially crystallographically unoriented, substantially magnetically isotropic alloys, with interaction between adjacent grains. By substantially isotropic is meant a material having properties that are similar in all directions. Quantitatively, substantially isotropic materials include those materials where the remanence along all three orthogonal axis, after application of the appropriate geometric demagnetization factor, are interactively enhanced, i.e., greater than 8 kilogauss, as well as those materials where the average value of [Cos(theta)], defined above, is less than about 0.75 in all directions, where Cos (theta) is averaged over all the crystallites. The material is substantially macroscopically isotropic. Microscopically this means that the direction of the easy axis of magnetization of a grain is random and is substantially uncorrelated from grain to grain.

The materials are permanent (hard) magnets, with enhanced magnetic parameters, i.e., isotropic maximum magnetic energy products greater than 15 megagaussoersteds, magnetic retention parameters, Q, greater than 0.75, standard temperature coercivities greater than about 8 kilooersteds, and remanences greater than about 9 kilogauss, and preferably greater than above about 11 kilogauss.

The saturation magnetization $M_s$ of the ribbon, i.e., the magnetization in the limit of large applied fields, is 15 to 16 kilogauss, also in all directions. These values correspond to a value of $M_r/M_s$ greater than 0.6, and a magnetic retention parameter, Q, greater than 0.75, in contradistinction to the clear teachings of the prior art for a macroscopically isotropic material. For the materials of optimally enhanced remanence Q is greater than 1.0.

The grains are in intimate structural and metallic contact along their surfaces, i.e., along their grain boundaries. That is, one grain of the material is in direct contact with an adjacent grain of the material at a grain boundary that is substantially free of intergranular materials and/or phases. This is contradistinction to the clear teachings of Raja K. Mishra, "Microstructure of Melt-Spun Nd-Fe-B Magnequench Magnets," Journal of Magnetism and Magnetic Materials, Vol 54–57 (1986), pages 450–456 who teaches the necessity of a 10–20 Angstrom thick film of Nd-rich, B-lean phase, between $Nd_2Fe_{14}B_1$ grains. Mishra reports that this film is necessary as a pinning site for magnetic domain walls. By way of contrast, according to the instant invention grains of magnetic material are in direct contact with adjacent grains of magnetic material, e.g., grains of $Nd_2Fe_{14}B$ are in direct contact with adjacent grains of $Nd_2Fe_{14}B$.

The degree of magnetic enhancement is determined by the average characteristic dimension of the grains, Ro, the size distribution of the individual grain dimensions relative to this characteristic scale, and a characteristic dimension of the grain boundaries. The characteristic dimension of the grain boundaries must be small enough to allow interaction between adjacent grains across the grain boundaries.

The magnetic alloys are solidified or quenched to produce a precursor microstructure, which, when appropriately heat treated, results in a structure having these dimensions and morphologies and therefore exhibiting the above described improved magnetic parameters. These initially solidified particles much larger then the characteristic grain dimension $R_o$. A particle may contain at least $10^8$grains of characteristic grain size $R_o$.

The as heat treated dimensions and morphologies are critical in obtaining the enhanced remanence and magnetic retention parameters herein contemplated. For example, the large grain limit corresponds to the case of a high fraction of grains having a grain size or characteristic dimension larger than $R_o$. In the small grain limit, there is a high fraction of grains below a grain size of corresponding to the characteristic dimension $R_o$.

In the intermediate regime, for as heat treated grain characteristic dimensions sizes about $R_o$=200 Angstroms, the interaction acts to enhance remanence without significantly lowering the coercive force. Thus both Mr and $(BH)_{max}$ can be substantially enhanced, and an estimate of the magnitude of this effect can be determined by a simple model described in our commonly assigned copending U.S. application Ser. No. 893,516.

While the above illustrations of interactions across grain boundaries have been quantitatively described with respect to rare earth-transition metal-boron materials of tetragonal, $P4_2/mnm$ crystallography, especially the $Nd_2Fe_{14}B_1$ type materials, this is a general phenomenon applicable to other systems as well. The optimum characteristic grain dimension $R_o$, however, may be different in these other cases.

We expect that for $Pr_{2-x}Nd_xFe_{14}B_1$, $R_o$ will be approximately 200 Angstroms for all values of x. For $SmCo_5$, for example, where Curie temperature, Tc=900K, saturation magnetization, Ms=12 kG, and Hanisotropy=300 kOe, H(spin,spin)=9 MOe, so that $R_o$=(9 MOe)/(300 kOe)×2.5 Angstroms=(approximately) 80 Angstroms. S $R_o$=(12 MOe)/(80 kOe)2.5 Angstroms=(approximately) 400 Angstroms.

For randomly-oriented crystallites at the optimum size, the expected magnetic enhancement attributable to quantum mechanical magnetic coupling is comparable to that estimated above for $Nd_2Fe_{14}B$ type material—an increase in $BH_{max}$ by a factor of 2 to 3 above that predicted by the Stoner and Wohlfarth model, above.

The magnetic material is prepared by a two step solidification, heat treatment process. The solidification process yields a very low coercivity material, characterized as being one or more of amorphous, microcrystalline, or polycrystalline. The crystallites within the solid have, at this stage of the process, an average grain characteristic dimension less than that of the heat treated magnetic material, and too small to provide a practical coercivity.

The solidification process is carried out by: (a). providing a molten precursor alloy; (b). atomizing the molten alloy through orifice means to form individual droplets of the molten alloy; and (c). quenching the droplets of the molten alloy to form solid particles of the alloy.

Figure 1:
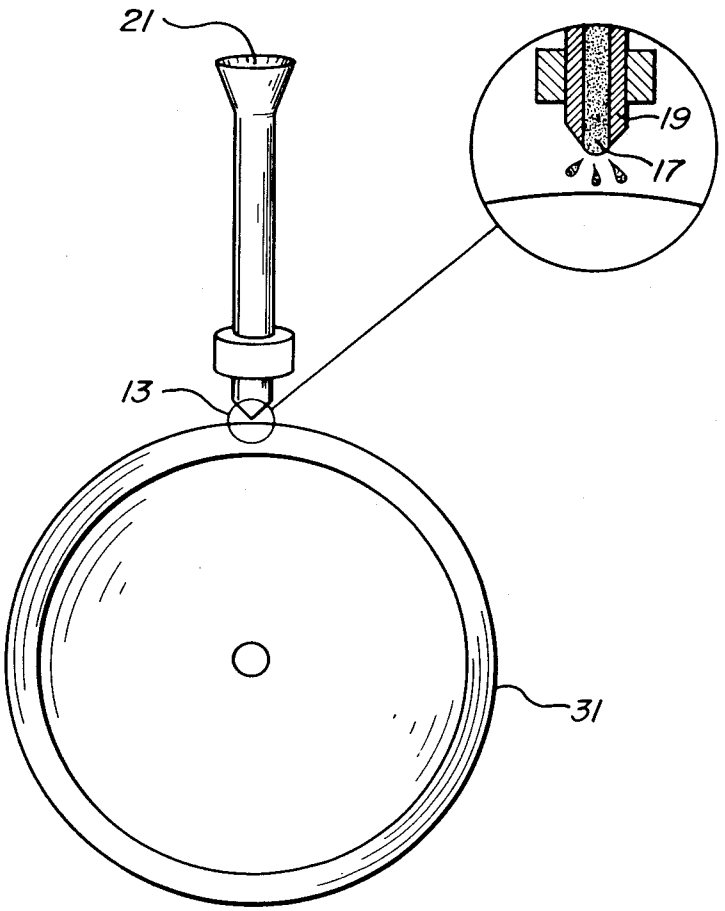
FIG. 1 show apparatus for the formation of molten metal droplets by generating a pressure wave, and thereafter quenching the droplets.

According to the embodiment shown in FIG. 1, a pressure wave is used to form droplets and propel them out of the crucible. As shown in FIG. 1, the molten precursor alloy is in a crucible means 11. The crucible means 11 is disposed above a chill surface means as chill wheel 31. The crucible means has an orifice 13 adapted for the capillary flow of the molten precursor alloy therethrough. The diameter necessary for capillary flow is determined by the surface tension between the capillary walls 15 and the molten precursor alloy. This allows for the formation of a meniscus 17 of molten precursor alloy at the outlet 19 of the orifice 13.

In combination with the orifice 13 are means 21 for applying a hydrostatic head to the molten precursor alloy. This may be in the form of one or more of a high head of molten alloy, an inert gas under pressure, or substantially continuous addition of molten alloy to the crucible 11.

Also in combination with the orifice 13 are means 31 for generating a pressure wave in the molten precursor alloy, e.g., the molten precursor alloy in the orifice 13. These pressure generating means 31 generate a pressure wave in the molten precursor alloy in the orifice 13.

When the pressure wave impulse is greater than surface tension of the molten precursor alloy in the orifice 13 droplets of the molten precursor alloy are formed. These droplets are quenched, e.g., by one or more of a stream of inert gas, radiant heat transfer, or contact with a quench surface means 31 to form the low coercivity alloy.

The pressure wave may be generated by piezoelectric means. The piezoelectric means may be concentric to the orifice 13, partially compressing the orifice 13 to retard the capillary flow of molten precursor alloy therethrough.

Alternatively, the pressure wave may be generated by magnetic means, as be magnetostriction of the orifice 13 to retard the capillary flow of the molten precursor alloy therethrough, or by magnetic induction means.

According to a further embodiment of the invention, shown in FIG. 2, an electrical field may be used to form the droplets and propel them from the crucible onto the chill surface. As shown in FIG. 2, the molten precursor alloy is in a crucible means 11. The crucible means 11 is disposed above a chill surface means as chill wheel 31. The crucible means has an orifice 13 adapted for the capillary flow of the molten precursor alloy therethrough. The diameter necessary for capillary flow is determined by the surface tension between the capillary walls 15 and the molten precursor alloy. This allows for the formation of a meniscus 17 of molten precursor alloy at the outlet 19 of the orifice 13.

In combination with the orifice 13 are means 61 for applying an electrical field between the molten precursor alloy and the chill surface means 31.

According to this embodiment an electrical field is established between the molten precursor alloy and the chill surface means 31. This field generates an electrostatic force between the molten precursor alloy in the orifice 13 and the chill surface means 31. When this electrostatic force is greater than surface tension of the molten precursor alloy in the orifice 13, droplets of the molten precursor alloy form and are drawn to the chill surface means 31. These droplets quench to form the low coercivity alloy.

The electrical field is preferably an alternating current electrical field. The frequency maximum intensity of the field is modulated with the hydraulics of the orifice 13, i.e., with the diameter of the orifice 13, the surface tension between the walls 19 of the orifice 13 and the molten alloy, the viscosity and density of the molten alloy, and the hydrostatic head on the molten alloy, to provide substantially continuous formation and flow of droplets of molten alloy.

The strength of the field should be high enough that, in combination with the above described hydraulic parameters, a narrow range of droplet size and a high quench rate are obtained. Preferably the electrical field is at least about one thousand volts per meter between the molten precursor alloy in the orifice 13 and the chill surface means. It is possible, with submicron to micron scale orifices 13, and a field of high frequency and 10,000 volts per meter to obtain droplets of under 1000 Angstroms diameter and instantaneous quench rates of as high as ten million degrees Kelvin per second.

In the second, or heat treating, stage of the process, the solid particles are heat treated to form a solid material having a morphology that provides a practical coercivity and the above described enhancement of remanence. The heat treated solid is comprised of grains meeting at grain boundaries. The grains and grain boundaries have the above described morphology associated with the enhanced remanence magnetic material.

In one exemplification the magnetic alloy material is an alloy of iron, optionally with other transition metals, as cobalt, a rare earth metal or metals, boron, and a modifier. In another exemplification the magnetic alloy material is an alloy of a ferromagnetic transition metal as iron or cobalt, with an lanthanide, as samarium, and a modifier.

A modifier is an alloying element or elements added to a magnetic material which serve to improve the isotropic magnetic properties of the resultant material, when compared with the unmodified material, by an appropriate processing technique. Exemplary modifiers are silicon, aluminum, and mixtures thereof. Alternative or additional modifiers may include lithium, hydrogen, fluorine, phosphorous, sulfur, germanium, and carbon. It is possible that the modifier acts as a grain refining agent, providing a suitable distribution of crystallite sizes and morphologies to enhance interactions.

The amount of modifier is at a level, in combination with the quench parameters, to give the above described isotropic magnetic parameters.

While the alloys referred to herein may have modifiers, which are believed to control grain nucleation and growth, the crystallite size and size distribution may be obtained by proper choice and control of the solidification technique employed. For example, such solidification methods as gas atomization, metallization, chemical vapor deposition, and the like may be used as an alternative to rapid solidification from the melt. The modifier, when present, acts during solidification from the liquid state, or during grain nucleation and growth from the amorphous state, e.g., as a grain refining agent or a nucleating agent, to provide the distribution of crystallite sites, size, and morphology necessary for enhanced properties.

While the below described magnetic alloy are shown with modifiers, it is to be understood that other techniques may be utilized to attain the uniform distributuion of nucleation sites.

The magnetic alloy may be of the type

[Rare Earth Metal(s)]-[Transition Metal(s)]-[Modifier(s)], for example

[Sm]-[Fe, Co]-[Si, Al].

Another interacting alloy may be of the type

[Rare Earth Metal(s)]-[Transition Metal(s)]-Boron-[modifier(s)], for example

[Rare Earth Metal(s)]-[Fe,Co]-Boron-[modifers(s)], and [Rare Earth Metal(s)]-[Fe,Co,Mn]-Boron-[modifier(s)].

In one exemplification, the magnetic alloy material has the stoichiometry represented by:

$$(Fe,Co,Ni)_a(Nd,Pr)_bB_c(Al,Si)_d,$$

exemplified $$Fe_a(Nd,Pr)_bB_c(Al, Si)_d,$$

where a, b, c, and d represent the atomic percentages of the components iron, rare earth metal or metals, boron, and silicon, respectively, in the alloy, as determined by energy dispersive spectroscopy (EDS) and wave length dispersive spectroscopy (WDS) in a scanning electron microscope;

$a+b+c+d=100$;

a is from 75 to 85;

b is from 10 to 20, and especially from 11 to 13.5;

c is from 5 to 10; and d is an effective amount, when combined with the particular solidification or solidification and heat treatment technique to provide a distribution of crystallite size and morphology capable of interaction enhancement of magnetic parameters, e.g., from traces to 5.0.

The rare earth metal is a lanthanide chosen from neodymium and praseodymium, optionally with other lanthanides (one or more La, Ce, Sm, Eu, Gd, Tb, Dy, Ho, Er, Tm, Yb and Lu), Sc, Y, and mixtures thereof present. While various combinations of the rare earth metals may be used without departing from the concept of this invention, especially preferred rare earth metals are those that exhibit one or more of the following characteristics: (1) the number of f-shell electrons is neither 0 (as La), 7 (as Gd) or 14 (as Lu), (2) low molecular weight lanthanides, such as La, Ce, Pr, Nd, and Sm, (3) high magnetic moment lanthanides that couple ferromagnetically with iron, as Nd and Pr, or (4) relatively inexpensive lanthanides, as La, Ce, Pr, and Nd. Especially preferred are Nd and Pr. Various commercial and/or byproduct mischmetals may be used. Especially preferred mischmetals are those rich in Nd and/or Pr.

While the invention has been described with respect to certain preferred exemplifications and embodiments thereof, it is not intended to limit the scope of the invention thereby, but solely by the claims appended hereto.

We claim:

1. A method of forming an enhanced remanence magnetic material comprising a solid mass of grains, which method comprises the steps of:

(a) providing a molten precursor alloy comprising (i) a transition metal chosen from the group consisting of Fe, Ni, Co, and combinations thereof, (ii) a rare earth metal chosen from the group consisting of neodymium, praseodymium, and combinations thereof, (iii) boron, and (iv) a modifier chosen from the group consisting of silicon, aluminum, and combinations thereof;

(b) atomizing the molten alloy through orifice means to form individual droplets of the molten alloy;

(c) quenching the droplets of the molten alloy to form solid particles of low coercivity alloy, the solid particles having a morphology characterized as being one or more of (i) amorphous;

(ii) microcrystalline; and (iii) polycrystalline;

wherein grains thereof have an average grain characteristic dimension less than that of the optimum enhanced remanence magnetic material; and (d) heat treating the solid particles to form the enhanced remanence solid magnetic material comprised of individual grains meeting at grain boundaries, the grains and grain boundaries having the morphology to provide enhanced remanence; the magnetic material having a tetragonal phase of $P4_2/mnm$ crystallography formed of grains having a characteristic grain dimension, Ro of about 200 Angstroms, and a distribution about the characteristic grain dimension to substantially avoid the effects of low coercivity and multidomain grains, such that the grain-grain interaction in the heat treated magnetic material substantially equals the magnetic anisotropy field of the individual grains, and having the composition $(Fe, Co, Ni)_a(Nd, Pr)_bB_c(Si, Al)_d$ where $75<a<85$, $10<b<20$, $5<c<10$, $o<d<5$, and $a+b+c+d=100$, and being characterized by:

(1) an isotropic maximum magnetic energy product, $(BH)_{max}$, greater than 15 megagaussoersteds; and (2) a coercivity greater than 8 kilooersteds at 27° C.

2. The method of claim 1 wherein the interaction betwen adjacent grains of the heat treated magnetic material is strong enough to magnetically align the grain away from its easy axis of magnetization.

3. The method of claim 2 wherein the anisotrophy energy of the individual grains of the heat treated magnetic material is strong enough to result in a coercivity above about 8 kilooersteds.

4. The method of claim 1 comprising the steps of:

(a) providing the molten precursor alloy in a crucible means disposed above a chill surface means, and having:

(1) an orifice adapted for the capillary flow of molten precursor alloy therethrough and the formation of a meniscus of molten precursor alloy at an outlet thereof, (2) means for applying a hydrostatic head to the molten precursor alloy, and (3) means for generating a pressure wave in the molten precursor alloy in the orifice;

(b) generating a pressure wave in the molten precursor alloy in the orifice, the pressure wave impulse being greater than surface tension of the molten precursor alloy in the orifice whereby to form droplets of the molten precursor alloy; and (c) quenching the droplets to form the low coercivity alloy.

5. The method of claim 4 comprising generating the pressure wave by piezoelectric means.

6. The method of claim 4 comprising generating the pressure wave by magnetic induction means.

7. The method of claim 1 comprising the steps of:

(a) providing the molten precursor alloy in a crucible means disposed above a chill surface means, and having:

(1) an orifice adapted for the capillary flow of molten precursor alloy therethrough and the formation of a meniscus of molten precursor alloy at an outlet thereof, (2) means for applying a hydrostatic head to the molten precursor alloy, and (3) means for applying an electrical field between the molten precursor alloy and the chill surface means;

(b) providing an electrical field whereby to generate an electrostatic force between the molten precursor alloy in the orifice and the chill surface means, the electrostatic force being greater than surface tension of the molten precursor alloy in the orifice so as to form droplets of the molten precursor alloy; and (c) quenching the droplets to form the low coercivity alloy.

8. The method of claim 7 comprising providing an alternating current electrical field between the molten precursor alloy in the orifice and the chill surface means.

9. The method of claim 7 comprising providing an electrical field of at least about one thousand volts per meter between the molten precursor alloy in the orifice and the chill surface means.

10. The method of claim 7 comprising providing an electrical field between the molten precursor alloy in the orifice and the chill surface means high enough to form submicron droplets.

11. The method of claim 1 wherein the alloy has the nominal composition $RE_2TM_{14}B_1$, where RE represents a rare earth metal or metals, and TM represents a transition metal or metals.

* * * * *